United States Patent [19]

Murphy et al.

[11] Patent Number: 4,713,640

[45] Date of Patent: Dec. 15, 1987

[54] MOLDED-CASE CIRCUIT BREAKER WITH IMPROVED CONTACT ARM ASSEMBLY, TOGGLE LINK MEANS AND ARC SHIELD COMPONENT

[75] Inventors: Glenn L. Murphy, Oxford; Russell T. Borona, Seymour; Francis L. Gelzheiser, Fairfield, all of Conn.

[73] Assignee: Westinghouse Electric Corp., Pittsburgh, Pa.

[21] Appl. No.: 944,137

[22] Filed: Dec. 22, 1986

[51] Int. Cl.[4] ..... H01H 3/00

[52] U.S. Cl. ..... 335/194; 335/6; 335/16; 200/153 SC

[58] Field of Search ..... 335/6, 8, 9, 10, 16, 335/147, 194, 195, 185, 189, 190; 200/153 SC

[56] References Cited

U.S. PATENT DOCUMENTS 4,484,164 11/1984 McClellan et al. ..... 335/16

4,567,455 1/1986 Hosogai et al. ..... 335/16

*Primary Examiner*—E. A. Goldberg

*Assistant Examiner*—Lincoln Donovan

*Attorney, Agent, or Firm*—L. P. Johns

[57] ABSTRACT

The pivot shaft which couples the contact arm to the side support plates of a molded-case type circuit breaker is provided with a pair of spacer members that hold the contact arm in precise centered position relative to the support plates and prevent the contact arm from shifting laterally along the pivot shaft during trip and reset operations of the circuit breaker. The movable contact thus swings along a fixed predetermined arcuate path when the circuit breaker is tripped and subsequently reset. The toggle assembly is also simplified and reduced in size and cost by employing a single, upper toggle link and pivot shafts that are each anchored in place by an integrally-formed shoulder at one end and a force-fitted lock washer at the other end. The arc-quenching ability of the circuit breaker is also enhanced by providing a U-shaped arc shield within the breaker housing which defines an enlarged rectangular arc chamber that is centrally traversed by the movable contact as it swings along its fixed predetermined arcuate path when the circuit breaker has been tripped.

6 Claims, 13 Drawing Figures

MOLDED-CASE CIRCUIT BREAKER WITH IMPROVED CONTACT ARM ASSEMBLY, TOGGLE LINK MEANS AND ARC SHIELD COMPONENT

BACKGROUND OF THE INVENTION

1. Field of the Invention

This invention generally relates to circuit breakers and, more particularly, to a circuit breaker of the molded case type that has an improved contact arm assembly, toggle link means and an arc shield component that improve the performance and reliability of the circuit breaker and reduce its cost.

2. Description of the Prior Art

Circuit breakers of the molded case variety are well known in the art and generally comprise a pair of separable contacts that are opened and closed by an overcenter toggle assembly and a spring-powered operating mechanism that is releasably latched by a current-responsive trip means which is magnetically and/or thermally actuated. Such circuit breakers are disclosed and described in detail in U.S. Pat. Nos. 3,480,900 (Gelzheiser et al.); 3,492,614 (DeAngelo et al.); 3,559,156 (Coley); and 4,163,881 (Borona et al.).

While circuit breakers having the structural and design features embodied in the various units disclosed in the aforementioned patents provided the desired protection against current overloads for the electrical circuits in which they were employed, they had certain features which inherently detracted from the performance of the breakers and increased their manufacturing cost. In accordance with the prior-art breaker designs, the movable contact arm was pivotally mounted between a pair of support plates by a pivot shaft arrangement which permitted the contact arm to shift position laterally along the shaft when the contact arm swung toward and away from the stationary contact during circuit breaker operation. This shifting was limited to some degree by the coiled segments of the biasing spring which encircled the pivot shaft on either side of the movable contact arm.

The resulting variation in the lateral position of the contact arm on the pivot shaft produced corresponding variations in the spacing or gap between the contact at the free end of the arm and the arc shield as the contact swung through the shield during the contact-opening stroke of the circuit breaker. The non-uniform spacing between the movable contact and arc shield delayed the rapid quenching of the arc since the arc would inherently be concentrated in the part of the gap where the movable contact and arc shield were in closest proximity.

In accordance with the prior-art breaker designs, the movable contact arm was also coupled to the cradle link of the operating mechanism by a toggle assembly that included two pairs of toggle links which were pivotally coupled to one another by pins having protruding end portions that were fitted with force-fitted lock washers (known in the art as "Tinnerman" washers). Spacer washers were also placed between the pair of handle links and cradle links at the point at which they coupled to the lower and upper pairs of toggle links. The assembly of the toggle links, spacer washers, and the various pivot pins and lock washers was accordingly very difficult to perform in an efficient manner on a mass production basis.

Another disadvantageous feature of the prior-art circuit breakers was the utilization of an arc shield that had an angular-shaped grid portion which inherently reduced the arc gap.

SUMMARY OF THE INVENTION

The aforementioned disadvantages and other problems associated with the prior-art circuit breakers have been avoided in accordance with the present invention by providing a spacer member on the contact arm pivot shaft on either side of the contact arm during the assembly of these parts with the biasing spring and side support plates. The spacer members are preferably of substantially the same size and length and fit snugly between the support plates and associated sidewall surfaces of the contact arm. The arm is thus held in precise centrally located position between the support plates and the movable contact on the free end of the arm is swung along a fixed arcuate path that is in precise centralized relationship with the arc shield. The diameter of the spacer members is such that such members fit snugly within the coiled segments of the biasing spring that is mounted to the contact arm.

The manufacture and assembly of the toggle mechanism is simplified pursuant to the invention by replacing the pair of upper contact arm links and spacer washer with a single upper link that is positioned between the ends of the cradle link and the ends of the lower contact arm links and thus serves the dual purpose of a link member and a spacer element. In addition, the pivot pins heretofore used to couple the various links of the toggle assembly to each other and to the ends of the cradle and handle links are replaced by rivet-like pivot shafts having a head or shoulder at one end so that only one lock washer on each of the shafts is required to firmly anchor them in place. The improved toggle link assembly accordingly eliminates one of the upper contact arm links, two of the spacer washers and three of the lock washers heretofore employed to hold the parts of the toggle assembly in operative relationship.

The gap distance between the arc shield and the movable contact carried by the contact arm is increased in accordance with another facet of the invention by employing an arc shield that is U-shaped rather than angular configuration. The resulting enlarged rectangular shaped arc chamber defined by the arc shield, in combination with the precise central location and fixed swing path of the contact arm relative to the arc shield achieved by the pair of spacer members provided on the contact arm pivot shaft, provides a uniform and longer air gap between the contact and arc shield which ensures that the arc will be rapidly stretched and quenched in a reliable and consistent manner when the movable contact sweeps through the arc shield when the circuit breaker is tripped.

BRIEF DESCRIPTION OF THE DRAWINGS

A better understanding of the invention will be obtained from the exemplary embodiment shown in the accompanying drawings, wherein.

DESCRIPTION OF THE PREFERRED EMBODIMENT

While the present invention can be used in various types and sizes of circuit breaker apparatus, it is especially adapted for use in low voltage circuit breakers of the molded-case type and it has accordingly been so illustrated and will be so described.

Figure 1:
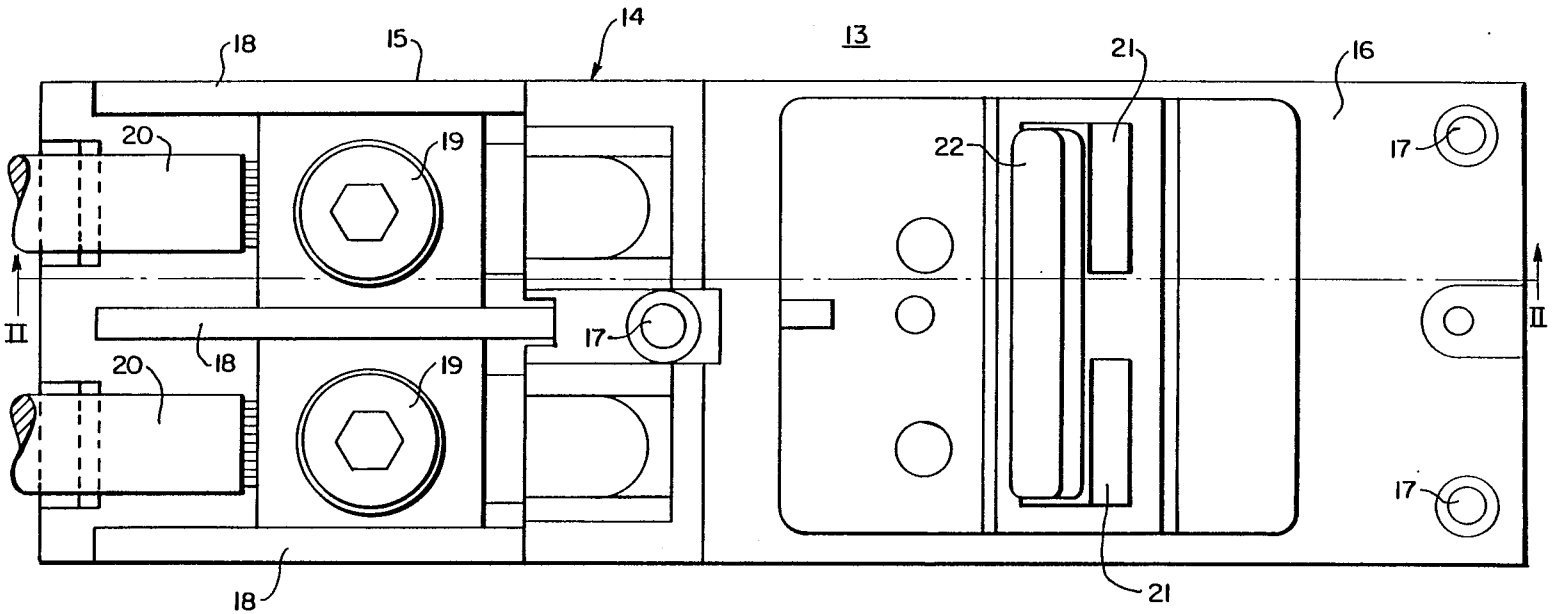
FIG. 1 is a top plan view of a two-pole molded-case circuit breaker embodying the present invention.

A circuit breaker 13 of such construction is shown in FIG. 1 and generally comprises a housing 14 of suitable insulating material that consists of a base 15 and a cover 16 that is secured to the base 15 by suitable fasteners such as rivets 17. The base 15 includes insulating partitions 18 which divide the housing 14 into two adjacent elongated cavities which contain a pair of circuit-breaking assemblies. The circuit breaker 13 is accordingly a two-pole unit. The cavities formed by the partitions 18 are open at one end of the housing 14 and accommodate a pair of clamp-type terminals 19 that connect the power lines 20 to the individual pole units. The pole units are operated by handles 21 that protrude through the cover 16 and are joined by connector bar 22 to permit the pole units to be manually operated in unison.

Figure 2:
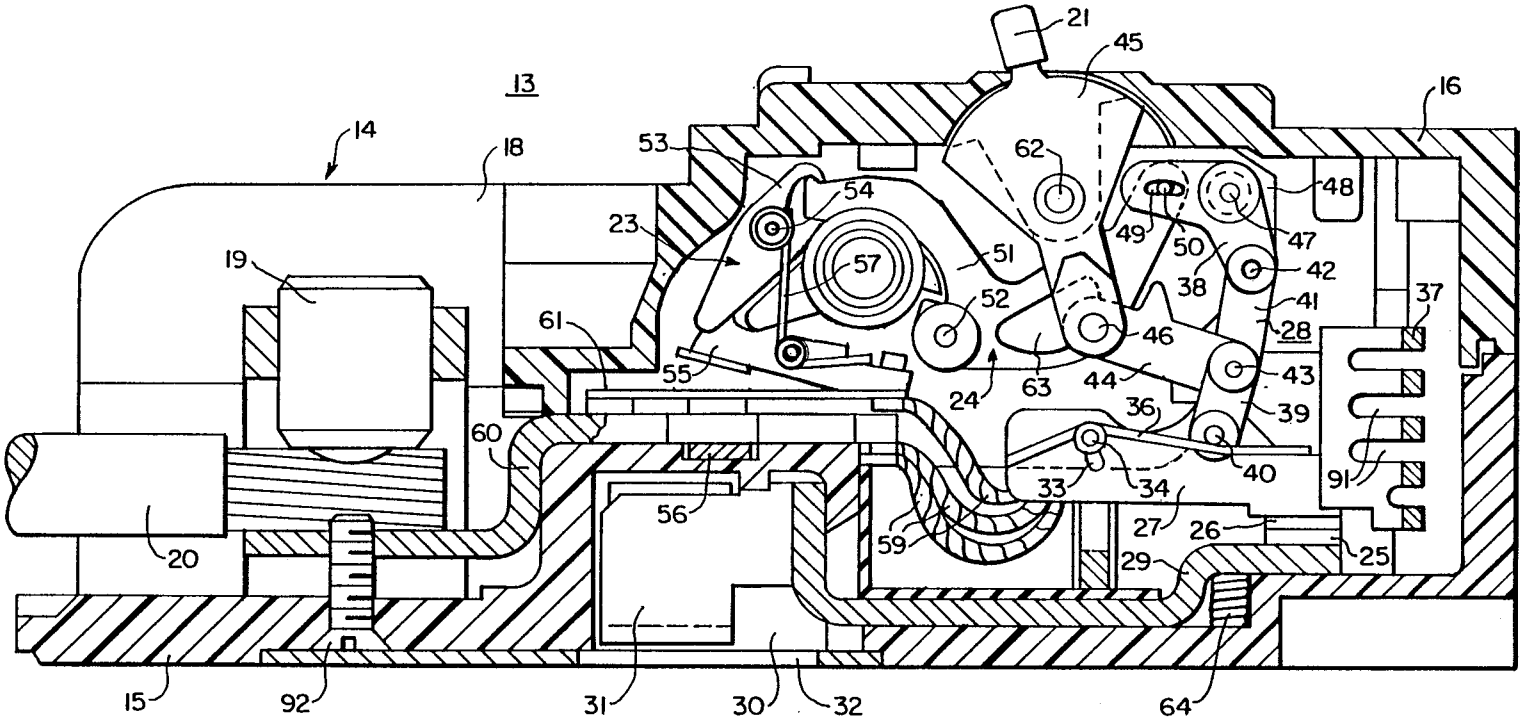
FIG. 2 is a sectional view along line II—II of FIG. 1 showing the circuit breaker in the ON position.

Each of the pole units is identical in structure and one of them is shown in detail in FIG. 2 which depicts the circuit breaker 13 in ON position. As will be noted, each pole unit comprises a trip assembly 23, an operating mechanism 24, a stationary contact 25, a movable contact 26 secured to the end of an elongated contact arm 27, and a toggle assembly 28 that couples the operating mechanism 24 to the contact arm 27. The stationary contact 25 is secured to a rigid conductor 29 that extends into a cavity 30 formed by the base 15 where the conductor 29 is connected to a clip-on type terminal 31 that is anchored in the cavity 30. The cavity 30 communicates with an opening 32 in the bottom of the base 15 to accommodate a stab conductor (not shown) that protrudes into the cavity 30 and engages the clip-on terminal 31.

Figure 7:
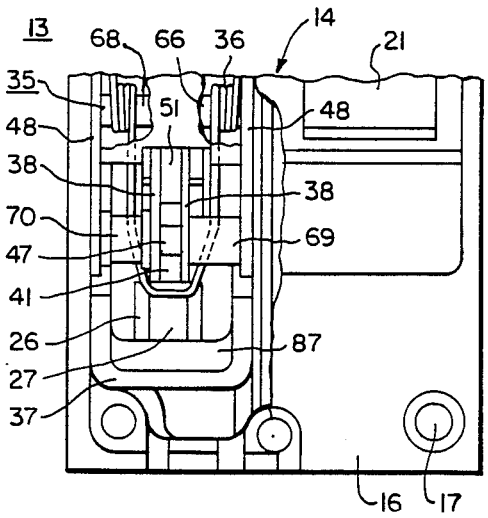
FIG. 7 is a plan view of the circuit breaker portion shown in FIGS. 5 and 6, parts of the breaker cover and operating handle being removed to show the biasing spring and associated parts of the contact arm pivot shaft assembly.
Figure 5:
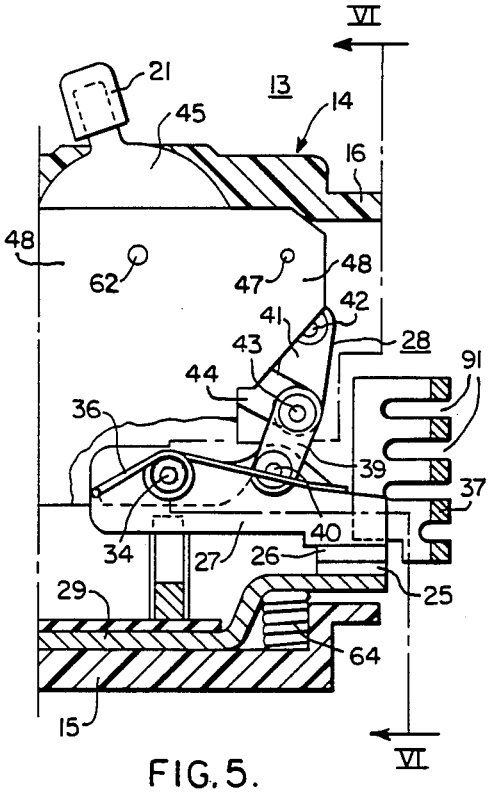
FIG. 5 is a fragmentary side elevational view, partly in section, of an end portion of the circuit breaker with the contacts closed and the operating mechanism in the ON position, showing the contact arm and toggle assemblies in greater detail.
Figure 6:
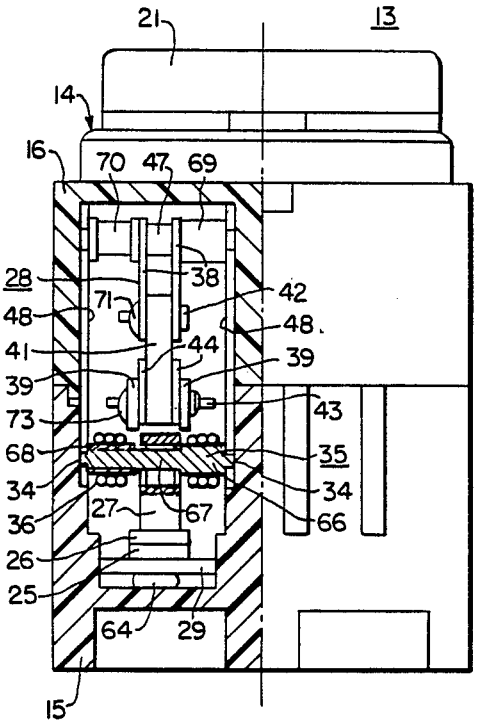
FIG. 6 is a sectional view of the circuit breaker portion, taken along line VI—VI of FIG. 5.
Figure 8:
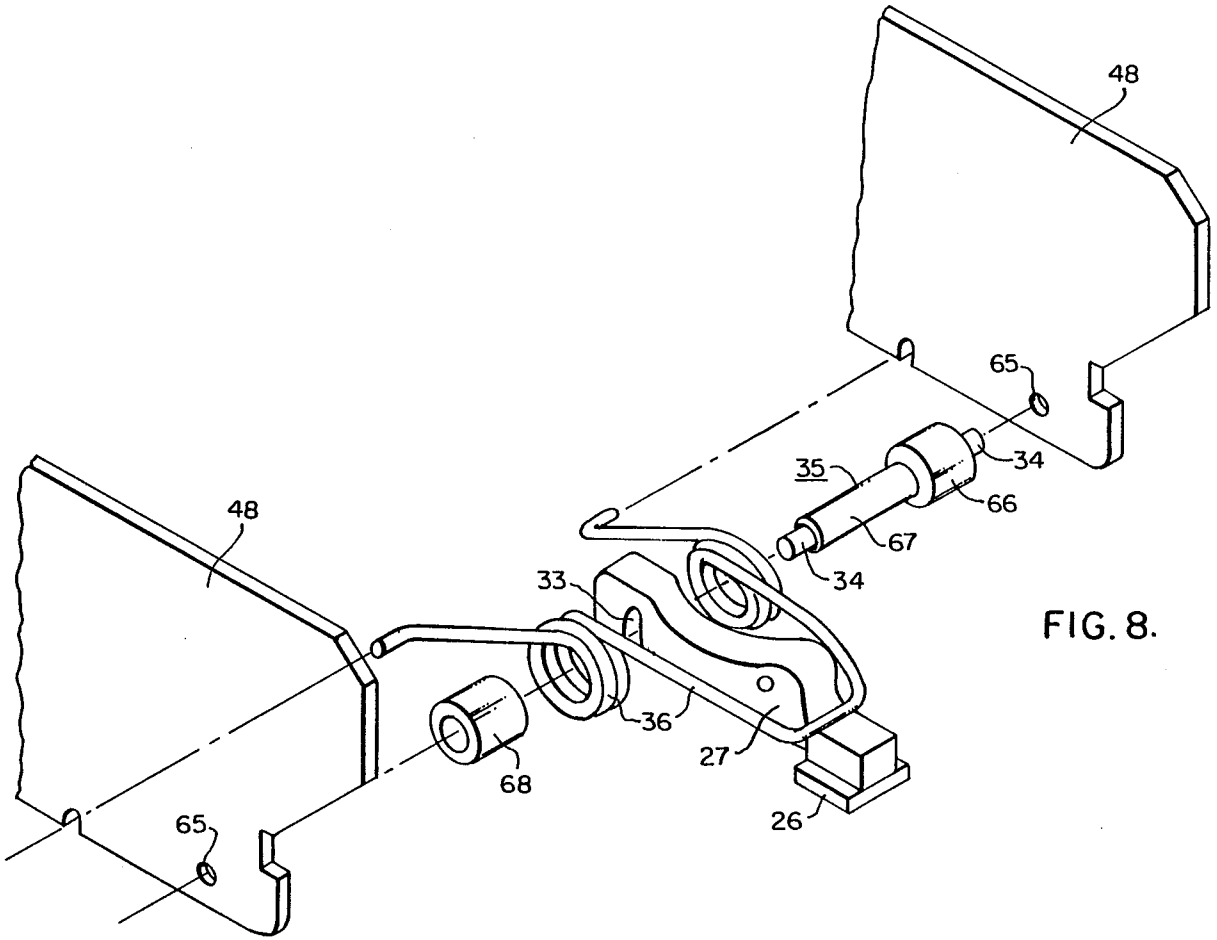
FIG. 8 is an enlarged exploded pictorial view of the contact arm assembly and coupled biasing spring according to the invention.

The contact arm 27 has a slot opening 33 therein that receives the end 34 of a pivot shaft 35 (shown in FIGS. 6–8 and permits the contact arm 27 and movable contact 26 to swing along a predetermined arcuate path within the circuit breaker housing 14. A torsion spring 36 biases the free end of the contact arm 27 to its contact-open position shown in FIGS. 3 and 4. An arc shield 37 having vent openings 91 is anchored within the base 15 and defines an arc chamber 87 (FIG. 7) through which the movable contact 26 swings when the circuit breaker 13 is tripped and subsequently reset.

The contact arm 27 is coupled to a pair of cradle links 38 of the operating mechanism 24 by the toggle assembly 28 that includes a pair of lower toggle (contact arm) links 39 that are pivotally connected to the contact arm 27 by a shouldered pivot shaft 40. In accordance with the present invention, the pair of lower toggle links 39 are coupled to the ends of the cradle links 38 by a single upper toggle (contact arm) link 41 and another shouldered pivot shaft 42. The toggle links 39, 41 are pivotally connected together by means of a knee pivot shaft 43 (having an integrally-formed head or shoulder) that also couples the toggle assembly 28 to a pair of handle links 44. The handle links 44 are, in turn, pivotally connected to an operating member 45 by a suitable pin 46. The handle 21 comprises part of the operating member 45 and protrudes through a suitable opening in the housing cover 16.

The shouldered pivot shafts 40, 42, 43 and contact arm pivot shaft 35 are of unique design and are described in detail hereinafter.

The cradle links 38 comprise two angular-shaped members that are movable as a unit around a fixed pivot 47 that is secured between a pair of rigid side support plates 48 (only one of which is shown in FIG. 2) that are mounted in the associated compartment of the circuit breaker housing 14. Both of the support plates 48 are shown in FIGS. 6–8 and such plates hold the trip assembly 23, operating mechanism 24, and contact arm 27 in operative relationship with one another.

As shown in FIG. 2, the free ends of the cradle links 38 are provided with slots 49 that receive a pin 50 which is carried by one end of a cradle 51 that is pivotally supported between the side plates 48 by a suitable pin 52. The cradle 51 is maintained in its latched position shown in FIG. 2 by means of the trip assembly 23. The trip assembly 23 comprises a latch member 53 that is pivotally supported between the side plates 48 by a pin 54 and has a toothed-shaped end portion that engages the similarly shaped end of the cradle 51 and latches the cradle 51 in its contact-closed ON position shown in FIG. 2. The lower end of the latch member 53 is coupled to the magnetic armature component 55 of an electromagnetic trip mechanism that includes a magnet 56. A spring 57 coupled to the armature component 55 biases the latch member 53 in a latching direction (clockwise as viewed in FIG. 2) about its pivot pin 54.

When the circuit breaker 13 is in the contact-closed ON position shown in FIG. 2, the circuit extends from the plug-in line terminal 31 through the conductor 29, stationary contact 25, movable contact 26, contact arm 27, several flexible conductors 59, a conductor 60 and a bimetal 61 (which define parallel conducting paths), to the power conductor 20 which is clamped in place by the terminal connector 19. Conductor 60 is a rigid conductor that is held in place within the base 15 by a suitable fastener 92. The main conducting path between the contact arm 27 and terminal 19 is through the rigid conductor 60 and the current which flows through the parallel conducting path defined by the bimetal 61 causes the bimetal to flex and trip the breaker 13 in the well-known manner when the current exceeds a predetermined value.

Manual operation of the circuit breaker 13 is achieved by manipulating the handle 21 which is attached to the insulating operating member 45 that is pivotally supported between the side plates 48 by a pin 62. The pin 46 which couples the handle links 44 to the end of the operating member 45 moves within a specially shaped opening 63 in the cradle 51 to permit the trip assembly 23 and operating mechanism 24 to move to their tripped contact-open positions and then be reset. The toggle assembly 28 simultaneously collapses and returns to its erect position in the well-known manner as required during the operation of the circuit breaker 13.

A detailed description of the thermal and magnetic trip means 23 and the operating mechanism 24 of the circuit breaker 13 and the manner in which they coact with one another to automatically trip the breaker 13 during current-overload conditions and then permit the breaker 13 to be reset and restored to contact-closed ON condition is set forth in the previously mentioned U.S. Pat. Nos. 3,480,900 and 4,163,881 and these patents are incorporated herein by reference.

When the circuit breaker 3 is in its ON position shown in FIG. 2, the contacts 25, 26 are in pressured engagement with one another as a result of the upward thrust provided by a coil compression spring 64 that is disposed between the rigid conductor 29 and base 15 of the breaker housing 14. The toggle assembly 28 is in erect position and the breaker handle 21 is located to the left in its ON position. The cradle 51 is held in captured relationship with the latch 53 and the magnetic latch component 55 is also in engaged position.

Figure 3:
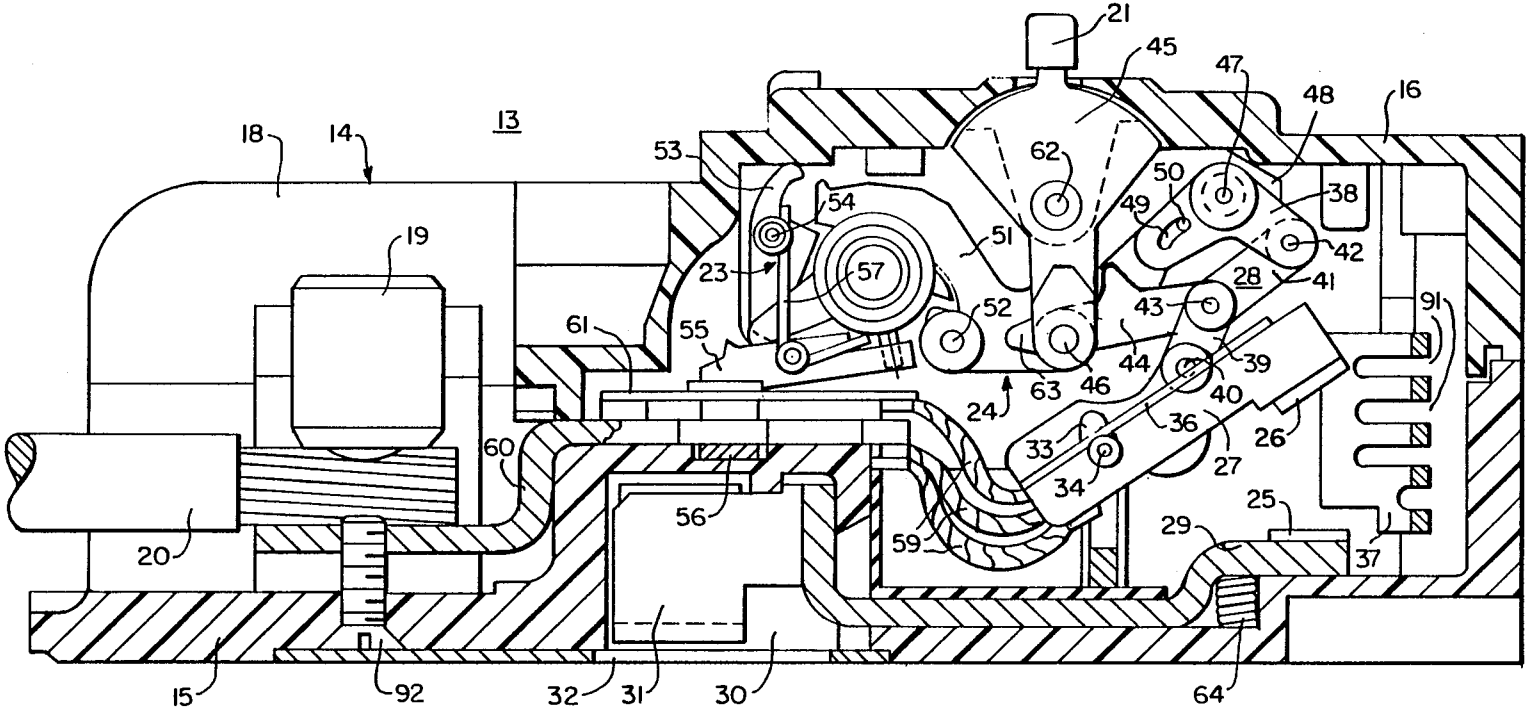
FIGS. 3 and 4 are similar views of the breaker in the tripped and OFF positions, respectively.

The circuit breaker 13 is shown in tripped condition in FIG. 3. As will be noted, the toggle assembly 28 is fully collapsed and the contact arm 27 has been swung upwardly under the action of the magnetic "blow-out" effect and the biasing spring 36 at a distance such that the movable contact 26 is located near the top of the arc shield 37 and is separated from the stationary contact 25 by a large air gap. The latch member 53 of the trip assembly 23 has released the cradle 51 and the magnetic latch 55 has been magnetically drawn into contact with the bimetal 61. The circuit breaker handle 21 is centrally positioned between its ON and OFF positions, which is the tripped-indicating position.

Figure 4:
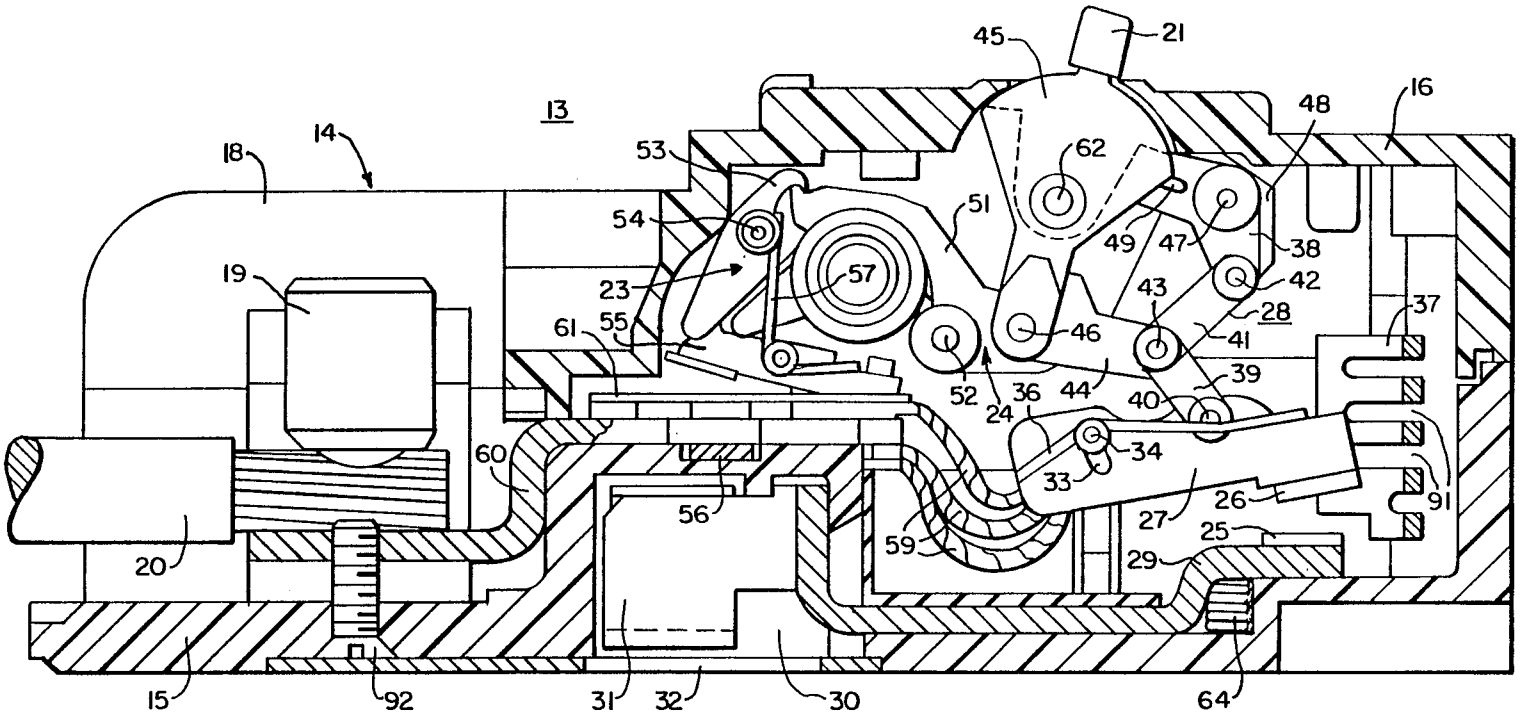

The circuit breaker 13 is shown in its OFF position in FIG. 4 prior after being reset for the next ON operation. As will be noted, the toggle assembly 28 has been restored to semi-erect position against the action of the biasing spring 36 so that the contacts 25, 26 are only separated by a small gap. The breaker handle 21 is disposed to the right at the extreme end of its travel and the latch 53 has been rotated into engaged position with the cradle 51 against the action of the other biasing spring 57. The magnetic latch member 55 has also been forced into engaged position with the latch 53. Resetting of the circuit breaker 13 to its ON position is accomplished in the well-known manner by forcing the breaker handle 21 to the left until it reaches its ON position—with the resultant restoration of the toggle assembly 28 to its fully erect position (shown in FIG. 2) and the downward movement of the contact arm 27 until the movable contact 26 is in firm pressured engagement with the stationary contact 25.

The novel features which are embodied in the circuit breaker 13 and constitute the subject matter of the present invention are shown in detail in FIGS. 5–9, 10 and 12A and will now be described.

As shown in FIGS. 5–8, the position and movement of the contact arm 27 and movable contact 26 during the trip and reset operations of the circuit breaker 13 are controlled in a very simple but effective manner by mounting the contact arm 27 on a specially-shaped pivot shaft 35 that is terminated at each end by short cylindrical end segments 34 that make a snug fit with suitable circular apertures 65 in the side plates 48. The shaft 35 has an enlarged cylindrical portion at one end that serves as an integral spacer member 66 which is disposed between the side wall of the contact arm 27 and the associated side plate 48 and also serves as a support means for one of the coiled portions of the biasing spring 36. The other end of the cylindrical medial segment 67 of the pivot shaft 35 is provided with a cylindrical sleeve 68 of substantially the same diameter and length as the integral-spacer portion 66 of the pivot shaft 35 and thus provides a second spacer member that is disposed between the other side face of the contact arm 27 and associated side plate 48. The other coiled segment of the biasing spring 36 is disposed in snug encircling relationship with the spacer sleeve 68, as illustrated in FIGS. 6–8.

The contact arm 27 is thus pivotally mounted in fixed centralized position between the side plates 48 by the integral-spacer portion 66 of the pivot shaft 35 and the spacer sleeve 68 so that the end of the contact arm 27 and the movable contact 26 move along a precisely controlled arcuate path without any swiveling or swaying during the trip and reset operations of the circuit breaker 13. The movable contact 26 accordingly swings along a predetermined arcuate path through the arc chamber 87 which ensures that it is in fixed centralized position relative to the arc shield 37 (as shown in FIG. 7) and equidistant from the surrounding sides of the shield. This provides a uniform arc gap and optimum stretching of the arc when the contacts 25, 26 are separated—thus enhancing the arc-quenching ability of the circuit breaker 13.

The structural details of the contact arm mount assembly and pivot shaft 35 and the manner in which the shaft 35 is assembled with the contact arm 27, biasing spring 36, spacer sleeve 68 and the two side plates 48 is shown in FIG. 8. As will be noted, the pivot shaft 35 is formed so that the integral cylinder spacer portion 66 is disposed at one end of the shaft 35 between the cylindrical medial segment 67 of the shaft 35 and the smaller diameter end segment 34 that slips into the aperture 65 in one of the side plates 48. The other reduced-diameter end segment 34 is inserted into the aperture 65 of the other side plate 48 after the medial segment 67 of the shaft 35 has been slipped through the coiled segments of the biasing spring 36, the arcuate slot opening 33 in the contact arm 27, and the cylindrical spacer sleeve 68.

If desired, the spacer member 66 can be formed as a second cylindrical spacer sleeve rather than as an integral part of the pivot shaft 35. However, this would increase the cost of the contact arm mount structure and complicate the assembly operation since an additional part would have to be formed and handled. A pivot shaft 35 having an integral-spacer portion 66 as illustrated is accordingly preferred.

In accordance with another facet of the present invention, the linkage which couples the contact arm 27 to the cradle links 38 and forms the toggle assembly 28 is simplified from both a manufacturing and assembly stand-point and made more compact than the linkage arrangements employed in the prior art. This improved linkage is most clearly shown in FIGS. 6–10 and will now be described.

Figure 9:
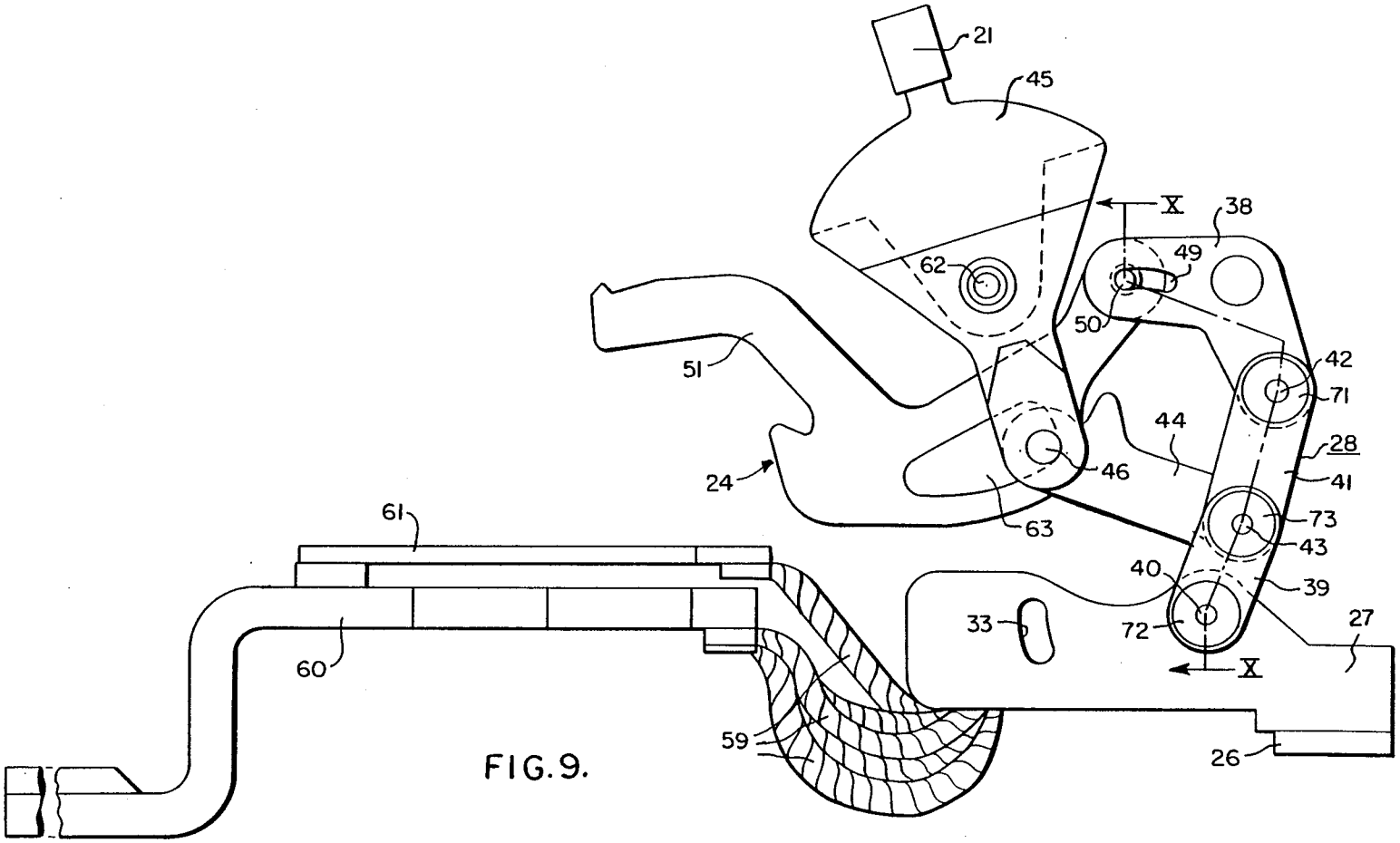
FIG. 9 is an enlarged side elevational view of the subassembly comprising the toggle assembly, contact arm and associated parts of the operating mechanism and thermal-trip actuating structure employed in the circuit breaker shown in the preceding Figures.

As will be noted in FIG. 9, the contact arm 27 is coupled to the cradle links 38 of the operating mechanism 24 by the toggle assembly 28 and the knee pivot shaft 43 of the toggle, in turn, is attached to the operating member 45 by the handle links 44. As shown in FIGS. 6 and 7, the cradle links 38 are mounted on the fixed pivot 47 and are held in central spaced-apart position between the side plates 48 by a pair of spacer elements 69, 70. As will also be noted in FIGS. 6 and 10, the handle links 44 are disposed in spaced-apart relationship between the pair of lower toggle links 39 which are, in turn, coupled to the contact arm 27.

In accordance with the present invention, the cradle links 38 are coupled to the lower toggle links 39 and handle links 44 by a single upper toggle link 41 that is disposed between the cradle links 38 and handle links 44 and thus serves as a spacer means that keeps them in the desired spaced-apart relationship. In addition, the single upper toggle link 41 is held in assembled relationship with the associated ends of the cradle links 38 by a rivet-like pivot shaft 42 that has a flat head and a staff portion that extends through suitable apertures in the links 38, 41 and is locked in place by a force-fitted lock washer 71 that is slipped over and frictionally grips the protruding end of the shaft 42. Such lock washers are known in the trade as "Tinnerman" washers. The components which hold the lower toggle links 39 in assembled relationship with the contact arm 27 and associated ends of the handle links 44 and the upper toggle link 39 also comprise preformed rivet-like pivot shafts 40, 43 that have head or shoulder portions and are held in place by other lock washers 72, 73.

The use of a single upper toggle link 41 that is disposed between and thus serves as a spacer element for the coupled ends of the cradle links 38 and handle links 44 (in combination with the rivet-like pivot shafts 40, 42, 43 and lock washers 71, 72, 73 eliminates several parts that were heretofore used in such toggle and contact arm assemblies and thus reduces the manufacturing cost of the breaker 13 and simplifies its fabrication on a mass-production basis.

Figure 10:
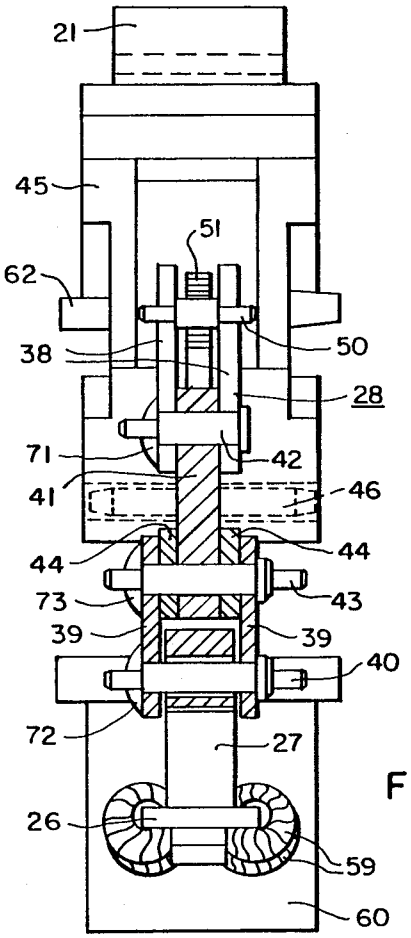
FIG. 10 is an end elevational view of the subassembly shown in FIG. 9 with the upper and lower toggle links and associated portions of the handle links and contact arm being shown in section along line X—X of FIG. 9.
Figure 11:
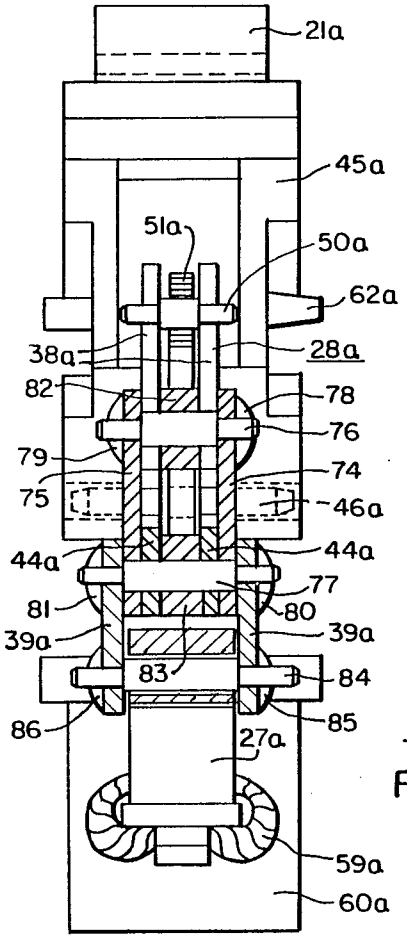
PRIOR ART FIG. 11.
FIG. 11 is a similar view of a prior-art subassembly which employs the dual upper contact arm links, spacer washers and conventional pivot pin and lock washer components.

These advantages are evident when the toggle and contact arm sub-assembly of the invention illustrated in FIG. 10 is compared with the corresponding subassembly employed in the prior art and shown in FIG. 11. As will be noted, the prior-art toggle assembly **28*a* employed a pair of upper toggle links 74, 75 that were held in place in overlying relationship with the outer end faces of the cradle links 38*a* and handle links 44*a* by pivot pins 76, 77 having protruding ends that were each fitted with lock washers 78, 79, 80 and 81 to hold the pins in assembled relationship with the associated components of the toggle assembly and operating mechanism. The prior-art design also required a pair of spacer members 82, 83 on the pins 76, 77 to maintain the coupled ends of the cradle links 38*a* and handle links 44*a* in the desired spaced-apart relationship. The prior-art subassembly also employed another pivot pin 84 to couple the lower toggle links 39*a* to the contact arm 27*a*, which pin was held in place by another set of lock washers 85, 86 that were force-fitted over the protruding ends of the pin 84**.

The use of a single, upper contact arm or toggle link 41 and shouldered pivot shafts 40, 42, 43 (with a corresponding number of lock washers 71, 72, 73) to couple the upper toggle link 41 to the lower toggle links 39 and the associated parts of the operating mechanism 24, and the lower toggle links 39 to the handle links 44 and the contact arm 27 accordingly eliminates one of the upper toggle links 74 and 75, the two spacer members 82, 83 and three of the lock washers 78, 80 and 85 that were required in the prior-art design (FIG. 11)—a total of six parts.

Another advantageous feature of the present invention is the use of an arc shield 37 that is of generally U-shape and thus provides a square-cornered arc chamber 87 (FIG. 7) of generally rectangular configuration which is traversed by the movable contact 26 when the circuit breaker 13 is tripped and the contact arm 30 is propelled upwardly by the biasing spring 36. The use of such a specially-configured arc shield 37 and the precise centralized fixed swing path of the movable contact 26 produced by the spacer sleeve 68 and spacer portion 66 of the contact arm pivot shaft 35 ensures that the arc is drawn away from the contacts and directed to the slot openings 91 in the shield 37 along the sides of the arc chamber 87—thus lengthening the arc and increasing the total surface area of the arc shield 37 which is available for thermal conduction.

Figure 12B:
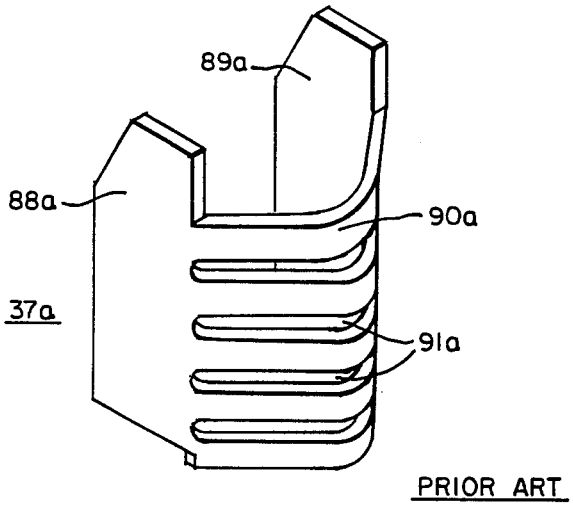
FIGS. 12A and 12B are enlarged perspective views of the improved arc shield and the arc shield used in the prior art circuit breakers, respectively.
Figure 12A:
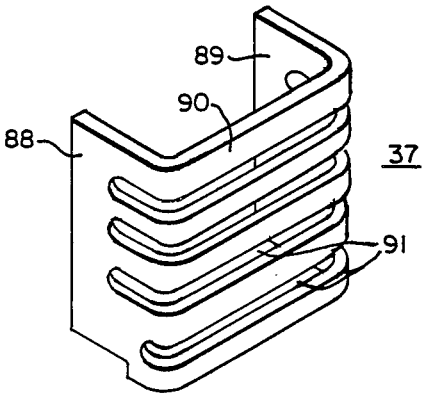

The improved arc shield 37 is shown in FIG. 12A and is formed from suitable sheet metal that is bent into U-shaped configuration with two end panels 88, 89 that are joined by a central panel 90. The arc shield 37 is provided with a plurality of slot openings 91 that extend laterally across the central panel 90 and a predetermined distance into the end panels 88, 89 to provide a grid-like structure which permits the ruptured gas created by the arc to pass through the shield 37 and harmlessly out of the circuit breaker housing 14. The manner in which the improved arc shield 37 and the stabilizing effect of the pivot shaft spacer members 66, 68 ensure that the movable contact 26 and contact arm 27 are centrally located within the rectangular-shaped arc chamber 87 defined by the arc shield 37 is shown in FIG. 7.

In contrast, the prior-art arc shield **37*a* (shown in FIG. 12B) has end panels 88*a*, 89*a* and an angular-shaped central panel 90*a* with laterally extending slot openings 91*a*. The resulting angular-shaped grid portion of the prior art shield 37*a* inherently decreases the gap distance between the movable contact as it swings through the arc shield 37*a*** when the circuit breaker is tripped.

We claim as our invention:

1. In combination with a circuit breaker having a stationary contact, a movable contact carried by an elongated contact arm, a trip assembly, a spring-biased operating mechanism, and a toggle assembly for swinging the contact arm and movable contact away from the stationary contact when the trip assembly is actuated and thereby rapidly separating said contacts, an improved mount assembly for said contact arm comprising;

a pair of spaced upstanding support members within the circuit breaker holding the trip assembly, operating mechanism, toggle assembly and contact arm in operative relationship, a pivot shaft rotatably coupled to said support members and extending laterally therebetween and through an opening in said contact arm, a pair of spacer members on said pivot shaft interposed between the side surfaces of said contact arm and the respective support members and maintaining said contact arm in predetermined spaced-apart relationship with said support members so that said contact arm and movable contact are swingable along a fixed predetermined arcuate path toward and away from the stationary contact when the circuit breaker is tripped and subsequently reset, said pair of support members comprising a pair of plates each having an aperture therein that are substantially aligned with one another, said pivot shaft terminating at each by an end segment that is seated in snug-fitting rotatable relationship with the apertured portion of the associated support plate, one of said spacer members comprising an integral part of said pivot shaft, the other of said spacer members comprises a sleeve that is in slip-fitted encircling relationship with said pivot shaft at a location remote from the integral spacer portion thereof, the apertures in said support plates are of substantially circular configuration, the end segments of said pivot shaft are of substantially cylindrical configuration, the medial segment of said shaft is also of substantially cylindrical configuration and has a diameter larger than the diameters of the cylindrical end segments, and said spacer sleeve and integral spacer portion of said pivot shaft are also of substantially cylindrical configuration and of substantially the same diameter and length so that the contact arm is centrally located between said support plates, the diameter of said spacer sleeve and the integral spacer portion of said pivot shaft being larger than the diameter of the medial segment of said pivot shaft.

2. The combination of claim 1 wherein the biasing spring of said operating mechanism is coupled to said support plates and has a pair of coiled segments that are disposed in slip-fitted encircling relationship with said spacer sleeve and the integral spacer portion of said pivot shaft.

3. The combination of claim 1 wherein;

said operating mechanism includes a handle that protrudes from the circuit breaker, a cradle, a handle link means, and a cradle link means, said toggle assembly couples the contact arm to said handle link means and cradle link means, said toggle assembly comprises a pair of lower toggle links coupled to the contact arm and handle link means, and a single upper toggle link that couples the pair of lower toggle links to the cradle link means, said cradle link means comprises a pair of cradle link members that are disposed in aligned spaced-apart relationship, said handle link means comprises a pair of handle link members that are also disposed in aligned spaced-apart relationship, the ends of said upper toggle link are disposed between the associated ends of said handle link members and said cradle link members and thus serve as spacer means therefore, and said upper toggle link is held in coupled relationship with the associated ends of said handle link members and said cradle link members by pivot shafts each of which has (a) a formed shoulder at one end, (b) a staff portion that extends through and beyond aligned apertures in the ends of the upper toggle link and associated ends of the cradle link members and lower toggle links, and (c) a lock washer that is in force-fitted anchored relationship with the protruding end of the staff portion of the shouldered pivot shaft.

4. The combination of claim 3 wherein the pair of lower toggle links are also in coupled relationship with the contact arm by a shouldered pivot shaft having a staff portion that extends through and beyond aligned apertures in the contact arm and associated ends of said lower toggle links and has a force-fitted lock washer anchored to the protruding end thereof.

5. The combination of claim 3 wherein;

said circuit breaker is of the molded-case type and has an insulating housing, and said housing contains an arc shield of metallic material that is of generally U-shape and defines a generally rectangular arc chamber that is traversed by the movable contact when the contact arm and movable contact are swung along said fixed predetermined arcuate path during operation of the circuit breaker.

6. The combination of claim 5 wherein;

the arc shield has a central portion with a purality of laterally extending slot openings therein and thus constitutes a grid structure for venting hot gases and residue generated by arc discharges that occur within the circuit breaker housing during trip operations, and said fixed predetermined arcuate path is substantially centrally disposed relative to the generally rectangular arc chamber defined by said arc shield.

* * * * *